US005163810A

United States Patent [19]

Smith

[11] Patent Number: 5,163,810

[45] Date of Patent: Nov. 17, 1992

[54] TORIC PUMP

[75] Inventor: John E. Smith, Rochester Hills, Mich.

[73] Assignee: Coltec Industries Inc, New York, N.Y.

[21] Appl. No.: 741,236

[22] Filed: Aug. 5, 1991

Related U.S. Application Data

[63] Continuation of Ser. No. 502,157, Mar. 28, 1990, abandoned.

[51] Int. Cl.[5] ..... F01D 1/12

[52] U.S. Cl. ..... 415/55.1; 415/55.4; 415/119; 416/203; 416/223 A; 416/228; 416/236 A

[58] Field of Search ..... 415/55.1, 55.2, 55.3, 415/55.4, 55.5, 55.6, 55.7, 119; 416/223 A, 228, 235, 236 R, 236 A, 203

[56] References Cited

U.S. PATENT DOCUMENTS

| | | | |
|---|---|---|---|
| 1,525,814 | 2/1925 | Lasche | 415/119 |
| 3,375,970 | 4/1968 | Zoehfeld | 415/55.2 |
| 3,804,547 | 4/1974 | Hagemann | 415/55.2 |
| 3,951,567 | 4/1976 | Rohs | 415/119 |
| 4,253,800 | 3/1981 | Segawa et al. | 415/119 |
| 4,474,534 | 10/1984 | Thode | 415/119 |
| 4,854,830 | 8/1989 | Kozawa et al. | 415/55.1 |
| 4,915,582 | 4/1990 | Nishikawa | 415/55.1 |
| 4,923,365 | 5/1990 | Rollwage | 415/119 |
| 4,938,659 | 7/1990 | Bassler et al. | 415/55.1 |
| 5,017,086 | 5/1991 | Hansen | 415/55.5 |

FOREIGN PATENT DOCUMENTS

| | | | |
|---|---|---|---|
| 0005594 | 1/1982 | Japan | 415/55.1 |
| 0222998 | 12/1983 | Japan | 415/119 |
| 0175297 | 8/1986 | Japan | 415/55.1 |

*Primary Examiner*—Edward K. Look
*Assistant Examiner*—Christopher M. Verdier
*Attorney, Agent, or Firm*—Howard S. Reiter

[57] ABSTRACT

A regenerative toric pump in which undesirable noise generation and leakage through the clearance gaps between the impeller and housing is minimized includes an impeller having vanes lying in general planes radiating from the impeller axis disposed at variable spacings from each other in a geometrically balanced pattern. Recesses in one of opposed side surfaces on the impeller and housing are arranged in a pattern such as to minimize leakage through the clearance gap between those surfaces from points in the pump chamber which are at different pressures.

6 Claims, 4 Drawing Sheets

TORIC PUMP

This application is a continuation of application Ser. No. 07/502,157, filed on Mar. 28, 1990 now abandoned.

BACKGROUND OF THE INVENTION

The present invention is directed to a toric pump having an improved impeller which minimizes internal leakage through the clearance gap between the impeller and pump housing and which minimizes the noise generated by operation of the pump.

Toric pumps of the type with which the present invention is concerned employ a disk-like impeller having a series of radial vanes mounted around its periphery. The opposed side surfaces of the impeller are flat, except for pockets between the vanes, and the impeller is mounted within a pump housing having an internal chamber having opposite side surfaces and a peripheral surface which closely enclose the impeller but allows sufficient clearance such that the fluid can exit the impeller radially and then turn forward or backward into the internal pump chambers of the housing. The chamber walls are formed with an internal pump chamber or passage extending along an annular path in operative relationship with the path of the impeller vanes at as constant radial distance from the impeller axis from an inlet at one end of the toroidal passage to an outlet at the opposite end. The circumferential extent of the toroidal passage around the pump axis is less than 360°, and between the ends of the passage a relatively narrow portion of the chamber side wall extends across the annular region traversed by the toroidal chamber. This portion of the chamber side wall is called the stripper and the stripper functions to deflect fluid being impelled through the pump chamber by the impeller vanes into the pump outlet instead of being pumped back to the inlet.

During operation of the pump, as each vane advances past the outlet end of the pump chamber to cross the stripper, the sudden reduction in the cross sectional area of the chamber through which the vane is moving generates a discontinuity in the fluid flow. Such a discontinuity occurs each time a vane passes across an edge of the stripper and, there is thus a generation of a cyclic change of resistance to the rotation of the impeller. Where the vanes are equally spaced around the impeller periphery, the frequency of this cyclic reaction is directly proportional to the rotative speed of the impeller, and at certain critical speeds, structural resonances or harmonics may develop which generate noise. It has been recognized in the prior art that this problem may be solved to some extent by varying the vane spacing around the periphery of the impeller. However, variable vane spacing usually results in the creation of at least some rotor imbalance which in turn leads to problems potentially more serious than undesirable noise.

A second problem encountered by pumps of types described above results from the fact that a slight clearance or gap must exist between the stationary pump housing surfaces and the adjacent rotating surfaces of the impeller in order that the impeller can freely rotate relative to the housing. Those portions of the chamber side surfaces and the opposed side surfaces of the impeller which are located radially inwardly of the toroidal pump chamber present a gap which extends the entire length of the radially inner side of the circumferentially extending pump chamber. Pressure progressively increases in this chamber from the inlet end to the outlet end, and the clearance gap provides a path for leakage of fluid from high pressure regions of the chamber to regions of lower pressure. Where the fluid being pumped is of low viscosity—i.e., air for example—this leakage can be substantial and substantially reduce the flow delivered by the pump.

Prior art attempts to employ a labyrinth type seal to reduce this leakage have not, in general been successful as demonstrated by the fact that very few, if any, commercially available regenerative pumps employ such seals. Labyrinth seals rely upon a series of restrictions separated by expansion chambers which are intended to enable the fluid entering the chamber to expand to an increased volume or bulk which is in theory more difficult to pass through the next following restriction. Where the fluid is of low compressibility, such as a liquid, no expansion takes place and the presence of the expansion chambers reduces the area available for restriction, thus reducing the effectiveness of the seal. Where the pump of the type described above is employed to pump gases, the gasses are highly compressible, but the pumps typically develop only a relatively small pressure differential between the inlet and outlet. Because of the relatively small differential between the density of the compressible fluid at the inlet and its density at the outlet, there is little opportunity for expansion of the gas in the expansion chambers of a labyrinth seal. Further, most of the prior art effort has focused on reducing leakage across the stripper between the inlet and outlet ends of the chamber while ignoring the fact that leakage likewise may occur between points in the chamber which are not necessarily closely adjacent the inlet or outlet.

The present invention is directed to a solution of the problems discussed above.

SUMMARY OF INVENTION

In accordance with the present invention, leakage through the gap between the opposed side surfaces of the pump housing and impeller is minimized by forming a plurality of concentrically arranged series of pockets in one of the opposed side surfaces. Each series of pockets includes a plurality of pockets circumferentially spaced from each other in a circular array about the impeller axis. The pockets of each series are so located that the pockets of one series circumferentially overlap the space between the pockets of the adjacent series. This arrangement assures that there is no truly direct line path of flow through the gap between separated locations in the pump chamber which open into the gap. Stated another way, any direct path through the gap between two points opening into the pump chamber is interrupted by at least one or more pockets so that the likelihood of establishing a continuous flow path for leakage between the two points is minimal. This arrangement is the most effective when the pockets are formed in the side surfaces of the impeller in that fluid which enters a pocket enters a moving pocket which disrupts the normal path of flow.

Minimization of noise generated by the pump operation is accomplished by effectively doubling the number of vanes on the impeller and operating the impeller at rotative speeds such that noise which is generated is generated at frequencies above the audible range. The rotor of the present invention is formed with an annular web at it outer peripheral portion which lies in a general plane normal to the axis of rotation of the impeller.

Vanes project radially outwardly from opposite sides of the web and are variably spaced from each other in a calculated mirror image pattern which is duplicated, but angularly offset by 180° at opposite sides of the impeller. The vane spacing and arrangement is such that no vane on one side of the rotor is in axial alignment with a vane on the opposite side of the rotor. Effectively, this doubles the total number of vanes and the axial extent of the individual vanes is reduced so that the flow discontinuity created by the passage of a vane across a stripper edge is minimized. By choosing the number of vanes to be located at one side of the impeller web to be the largest odd number of vanes consistent with convenient fabrication of the rotor (tooling or mold structure may establish a minimum limit to the spacing between adjacent vanes) and selecting a calculated vane spacing sequence a geometrically balanced impeller with variable vane spacing can be achieved.

Other objects and features of the invention will become apparent by reference to the following specification and to the drawings.

IN THE DRAWINGS

Figure 3:
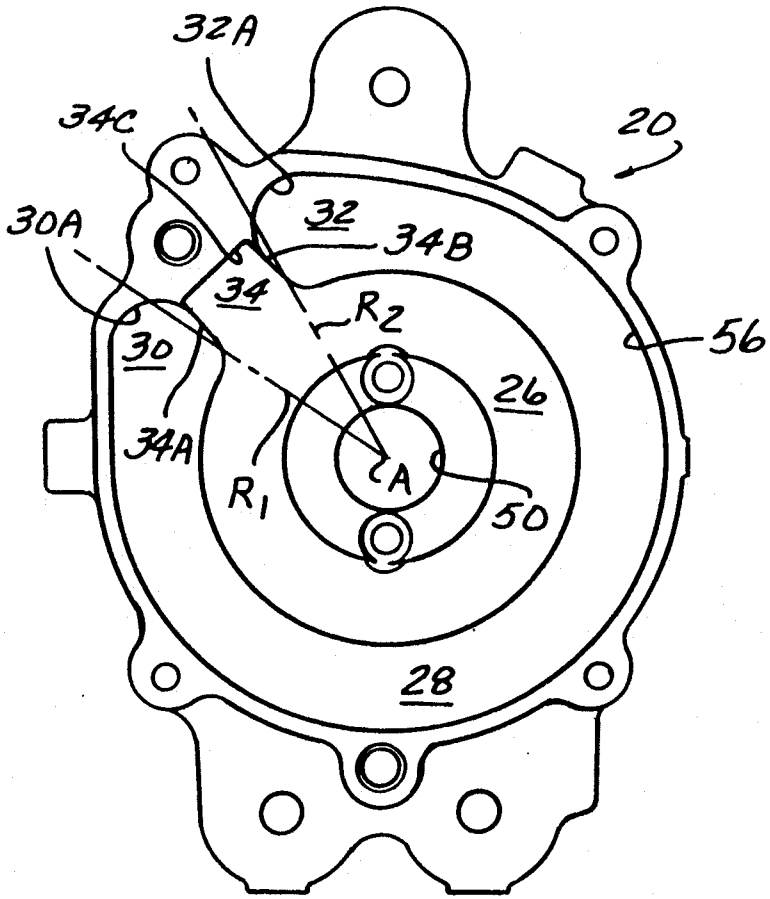
FIG. 3 is a front view showing the interior side of the pump housing of the pump of FIG. 1.

Referring first to FIGS. 1-5, a regenerative toric pump embodying the present invention includes an impeller housing designated generally 20 and a housing cover designated generally 22 fixedly and sealingly secured to each other as by bolts 24. For purposes of orientation, that side of the pump on which the cover 22 is located will be referred to as the front of the pump. Housing 20 is formed with a forwardly opening impeller receiving recess having a flat bottom surface 26 and an annular recess 28 which, as best seen in FIG. 3, extends circumferentially of the housing about a central housing axis A from an inlet end 30 to an outlet end 32 which are separated from each other by a stripper section 34 coplanar with the surface 26.

Cover 22 is formed with a flat rear face 36 and a similar annular recess 38 which extends circumferentially from an inlet 40 opening from recess 38 forwardly through the cover to an outlet 42 which likewise opens forwardly through cover 22, the inlet and outlet ends of the annular recess 38 being separated from each other by a stripper portion 44 coplanar with the flat rear face 36 of cover 22.

Figure 1:
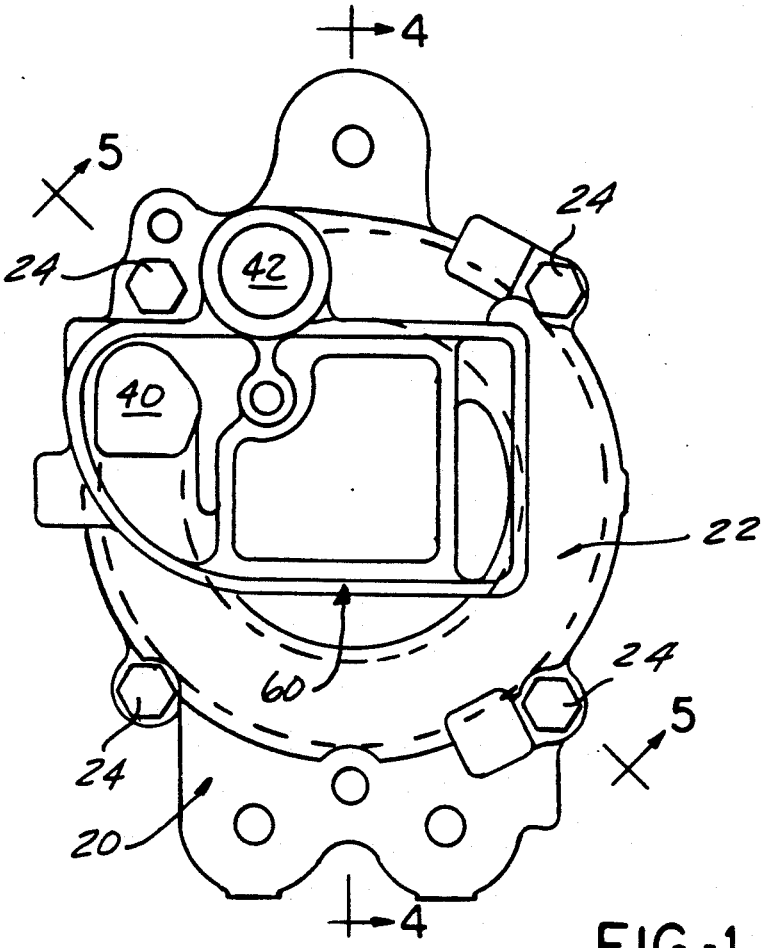
FIG. 1 is a front view of a regenerative toric pump embodying the present invention.
Figure 4:
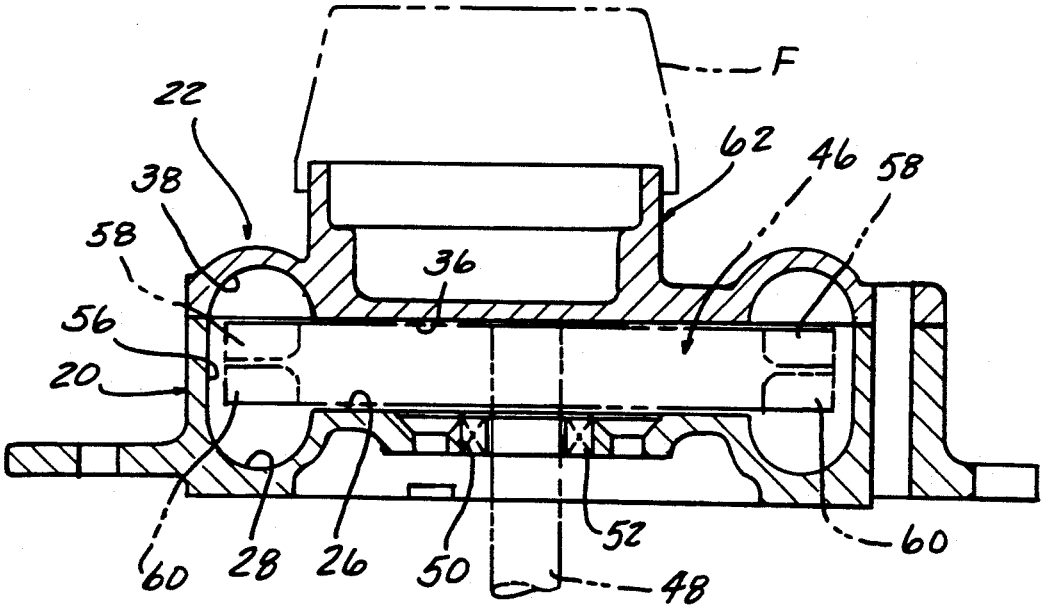
FIG. 4 is a cross sectional view taken on line 4—4 of FIG. 1.
Figure 5:
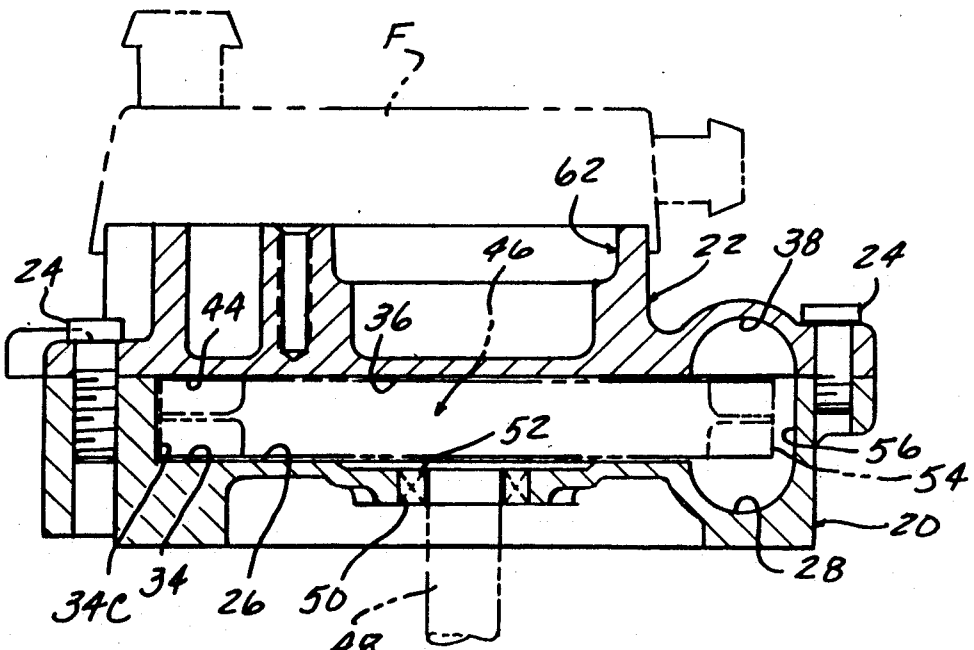
FIG. 5 is a detailed cross sectional view taken on line 5—5 of FIG. 1.

As best seen in FIGS. 4 and 5, when cover 22 is assembled upon housing 20, the flat faces 26 and 36 of the housing and cover respectively are disposed in spaced parallel relationship to each other by a distance which slightly exceeds the axial thickness of a disk shaped impeller designated generally 46 (See FIGS. 6 and 7) indicated in broken line only in FIGS. 4 and 5. Impeller 46 is received within the pump housing for rotation about the axis A and is rotatively fixed upon the end of an impeller drive shaft 48 rotatably mounted within a bore 50 coaxial with axis A of housing 20 as by a bearing 52. Impeller vanes 58, 60 respectively formed on the front and rear sides of the impeller are operable upon rotation of the impeller to impel air along the respective annular recesses of pump chambers 38, 28 in a well known manner. The clearance between the opposite side surfaces of impeller 46 and the flat surfaces 26, 36 on the housing and cover is chosen to be sufficient so as to assure there will be no contact between the rotating impeller and the fixed surfaces 26, 36 during operation of the pump. For reasons to be explained in more detail below, it is desirable that the impeller be driven at relatively high speeds of rotation—in the order of 10,000 rpm or higher—and any contact between the impeller and housing surfaces during operation must be avoided.

Similarly, a relatively small gap or clearance between the outer peripheral surface 54 of the impeller and the opposed peripheral surface 34C, (FIGS. 3 and 5) of the stripper portion of the impeller receiving recess in housing 20 is required. Because recess 28 in housing 22 is located at the rear side of the impeller, and the inlet 40 and outlet 42 of the pump enter the interior chamber through the cover at the front side of impeller 46, recesses 28 and 38 are formed at their inlet ends 30, 40 with radially outwardly extending enlarged portions 30A, 40A so that fluid entering through inlet 40 can flow across the outer periphery 54 of impeller 46 via the enlargements 40A, 30A to the rear side of the impeller. Similar enlarged portions 32A, 42A are formed at the outlet ends 32, 42 of the recesses 28, 38.

In the particular cover 22 shown in the drawings, external connections to inlet and outlet 42 are made through a filter housing indicated in broken line at F in FIGS. 4 and 5 which is seated upon a filter chamber defining formation designated generally 62 on the front side of the cover 22. The filter F - filter chamber 62 arrangement provides a convenient means for filtering incoming air when the pump is employed to pump air. While the pump disclosed in the application drawings is specifically intended to supply air as required to an automotive emission control system, the pump described has other applications and is readily adapted for use in pumping liquid or fluids other than air.

Regenerative toric pumps of the general type here disclosed are known in the prior art and, as stated above, have two inherent problems in their design. The first of these two problems is the generation of noise resulting from the cyclic passage of the rotor vanes into and out of the restricted passage constituted by the opposed stripper portions 34, 44 whose presence is required to deflect fluid from the annular recess or pump chamber into the pump outlet. The second problem is that of leakage of the fluid being pumped through the clearance gaps between the opposed surfaces of the rotating impeller and pump housing.

The present invention addresses the problem of noise generation by employing a relatively large number of vanes on the impeller which are arranged in a predetermined non uniformly spaced pattern and by forming the stripper portion edges to extend along a non radially inclined edge.

Figure 2:
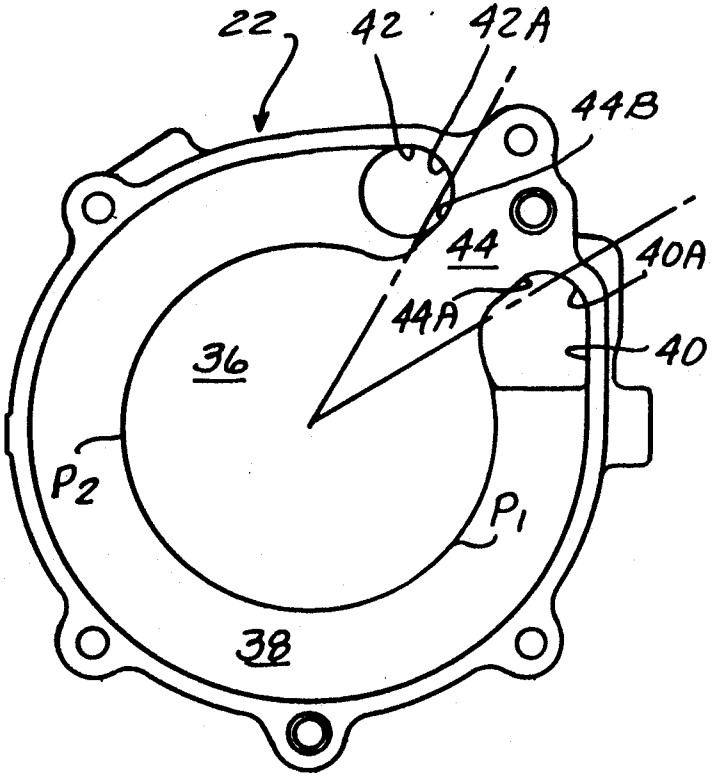
FIG. 2 is a rear view showing the inner side of the pump housing cover of the pump of FIG. 1.

Referring now particularly to FIG. 3, it is seen that the edges 34A, 34B of the stripper portion 34 of the pump housing do not lie on lines radial to axis A, such as lines R1 and R2, but are instead inclined to those radial lines. As will be described in more detail below, the various waves 58, 60 of the impeller lie in general planes which extend radially from axis A. In FIG. 3, which shows the front side of housing 20, the direction of rotation of the impeller would be in a counter-clockwise direction so that the vanes would advance air (or whatever fluid is being pumped) along the annular recess 28 from inlet end 30 to outlet end 32. Because of the inclination of edge 34B of the stripper to the radial line R2, as a vane on the impeller passes in a counterclockwise direction from outlet end 32 of recess 28 into overlying relationship with the stripper portion 34, the radially extending vane is inclined to the stripper edge 34B so that as the vane advances from the relatively large passage defined by the annular recess 28 into the relatively restricted passage defined by stripper portion 34, the entire vane does not attempt to enter this restricted passage simultaneously, as would be the case if both the vane and edge 34B extended in a radial direction. Effectively, the inclination of edge 34B to the radial line R2 slices air from the vane edge, rather than chopping it as would be the case if edge 34B extended along a radius from axis A. This arrangement cushions to some extent the fluid shock occasioned by the transit of the vane from a relatively unrestricted passage into an extremely restricted passage. A similar action occurs at edge 34A, and as is best seen in FIG. 2, the corresponding edges 44A and 44B of the opposed stripper portion 44 on cover 22 are inclined similarly to radial lines extending from the axis A.

Typically, the impeller 46 will be driven in rotation at a substantially constant speed which, if the vanes are equally spaced about the impeller circumference, will result in the passage of a vane edge across the edge of the stripper at a substantially constant cyclic frequency. Noise generated will be of this frequency and its harmonics and, when one of these frequencies approaches some natural frequency of the pump structure, amplification of the noise can occur. The prior art has recognized that some noise generation is inherent where an impeller with equally spaced vanes is driven at a constant speed across a stripper, and that noise generation may be reduced by arranging the vanes in a pattern in which the vanes are unequally spaced to avoid a constant frequency generation situation. However, unequal spacing of the impeller vanes typically creates other problems, such as impeller imbalance and increased manufacturing costs.

A second approach to minimizing the noise generation problem is to generate noise at frequencies above the audible range which, for most persons means frequencies above 15,000 cycles per second. In that the frequency of noise generated by the pump is essentially the product of the number of vanes on the impeller multiplied by the number of impeller revolutions per second, high speed operation of an impeller with a relatively large number of vanes offers the possibility of avoiding the generation of noise within the audible range.

Both of these approaches are employed in the impeller of the present invention, with special care being given to determining a pattern of variable vane spacing which also results in a geometric balance of the impeller.

Figure 7:
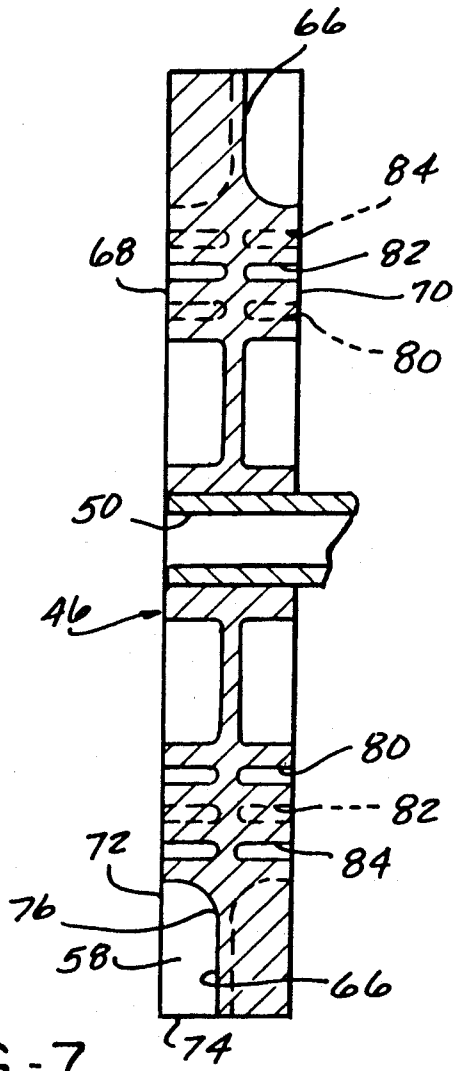
FIG. 7 is a detailed cross sectional view of the impeller taken on line 7—7 of FIG. 6.
Figure 6:
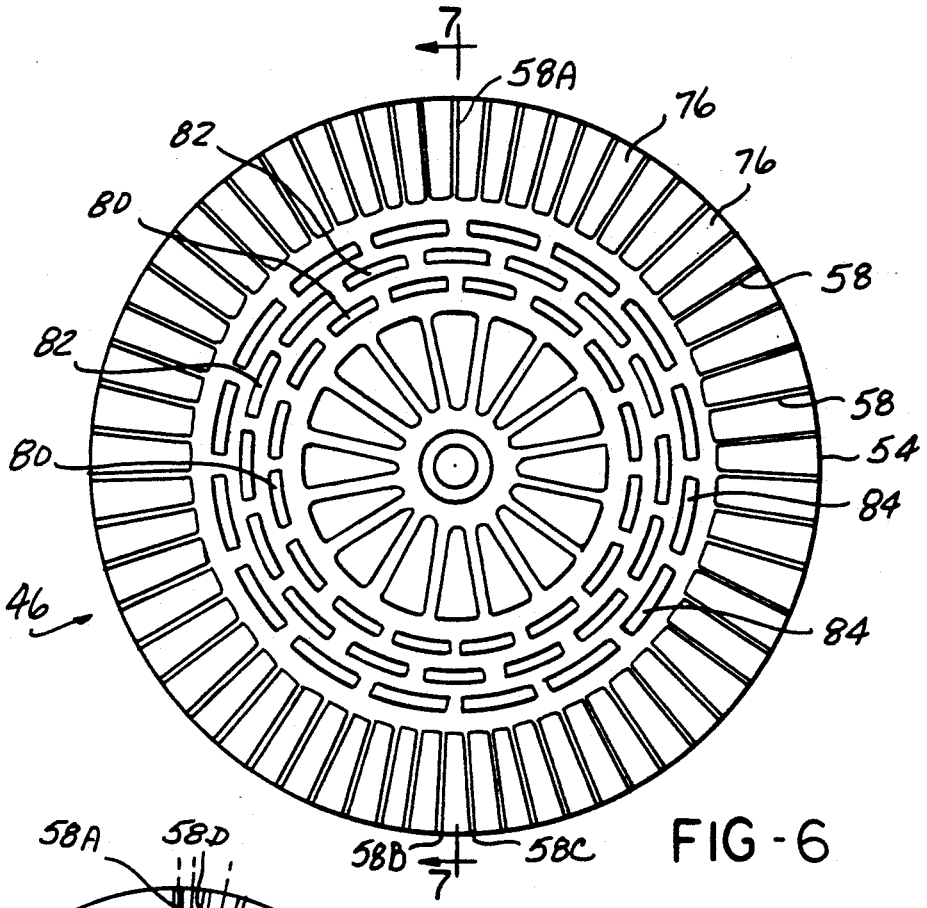
FIG. 6 is a side view of the impeller employed in the pump of FIG. 1, showing the front side of the impeller.

Referring first to the cross sectional view of FIG. 7, impeller 46 is formed with an annular web 66 at its outer peripheral portion which lies in a general plane normal to the impeller axis mid-way between the front and rear side surfaces of the impeller. Vanes 58 are project forwardly from the front side of web 66 and vanes 60 project rearwardly from the rearward side of web 66. Referring now particularly to FIG. 6, which is a front view of the impeller, it is seen that the vanes 58 lie in general planes which contain the axis of impeller 46 and radiate from the axis in angularly spaced relationship to each other. As best seen in FIG. 7, the front edges 72 of the vanes 58 lie in the plane of the front surface 68 of the impeller and the radially outer edges 74 of vanes 58 extend flush with the outer periphery of web 66. Pockets 76 are formed between adjacent vanes 58. The vanes 60 which project from the rearward face of web 66 are of a configuration similar to vanes 58.

In FIG. 6, the vanes on the front face of the rotor are arranged in a pattern which is determined in the following manner.

Rather than computing the space between adjacent vanes, which have a finite thickness, it is somewhat simpler and more convenient to assume that the vanes are of zero thickness and to compute the locations of the radial general planes which will bisect the space between adjacent vanes.

The first step in the procedure is to select a total number of spaces between the vanes at the front side of impeller 46. In order to assure that no vane on the front side of the impeller will be directly aligned with a vane on the rear side of the impeller, the number of spaces selected must be an odd number. The number chosen should be as large as possible, taking into account limitations imposed by structural strength requirements and the tooling and techniques employed to fabricate the impeller.

The number of spaces selected is then divided into 360° to determine the size (angular extent about the axis) of an average size space. To follow an exemplary calculation, it will arbitrarily assumed that 45 spaces are to be employed, in that this results in an average space of $360° \div 45$ or 8°.

The next step is to determine a maximum increment to be added or subtracted from an average space to determine the minimum and maximum space sizes. It will arbitrarily be assumed that the maximum departure from the average space size of 8° will be ±15% of 8° or 1.2°. This will give a maximum space size of 9.2° and a minimum space size of 6.8°. The minimum space size should then be checked to be sure it can be achieved by the tooling and techniques employed in fabricating the vanes. Typically, the impeller is formed by an injection molding or die casting technique and the machining of the mold or die cavity will be the determining factor.

Figure 8A:
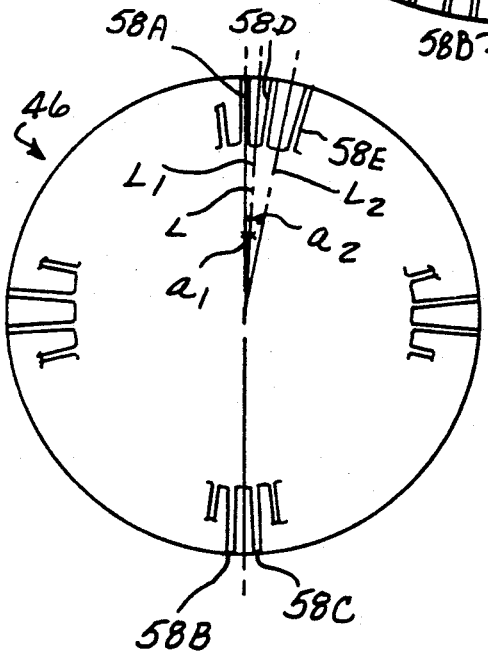
FIG. 8A is a schematic diagram illustrating the pattern of vane spacing employed at the front side of the impeller.

With an odd number of spaces, the pattern of the vanes on the front face of impeller 46 will be established with respect to a reference line L (FIG. 8A) which extends diametrically of the impeller and passes through the impeller axis. With an odd number of spaces, the line L, as indicated in FIG. 8A, can be so located as to pass through the central general plane of one vane 58A and bisect the space between the two vanes 58B and 58C at the opposite side of the impeller circumference.

The next step is to locate, through one 180° clockwise displacement from the reference vane 58A location the angular displacement from line L of the radial lines L1, L2, etc., which bisect the successive spaces in a clockwise direction from line L1 through 180°, assuming all spaces are of the average size. Since the average size of the spaces is 8°, line L1 of FIG. 8A will be displaced an angle $a_1$ from line L of 4°, line L2 will be displaced from line L1 by an angle $a_2$ 12°, subsequent lines L3, L4, etc., (not shown) will be displayed from the preceding line by 8° increments. The angles $a_1$, $a_2$ will be used in calculating the individual spacings.

For reasons which will become apparent, it is desired that the spaces in the first 90° of displacement clockwise from line L will be approximately, but not precisely symmetrically disposed with respect to the respective spaces in that quadrant between a 90° displacement from line L and a 180° displacement from line L. Therefore, it is convenient if the variation in space sizing follows some periodic function which will result in an increase in the space sizing through the first 90° from line L and a decrease in space sizing through the next 90°. One obvious choice of such a function is a sine or cosine function.

The sizes of the respective spaces clockwise from reference vane 58A through the first 180° as viewed in FIG. 6 may be determined by the following relationship:

$$S_n = D \sin[2 \times (a_n - 45°) + B$$

where n=a number of the space counting clockwise from reference vane 58A, S=the angular extent of the "space"-i.e., the angular displacement between the general planes of two adjacent vanes, $a_n$=the angle between line L1 and the center line of space $S_n$ if all spaces were of the average size—i.e., $a_n = n \times B - B/2$, where B is the average space (8° in the example given above) and D=the maximum increment to be added to or subtracted from the average space size—D=1.2° in the example give above.

The above formulation is but one of many which can be employed for computing a variable spacing between adjacent vanes. The foregoing formulation establishes a vane spacing pattern in which the vane spaces are of a minimum size adjacent reference vane 58A, increase progressively through the first 90° from line L1 and then decrease progressively to vane 58C.

Figure 8B:
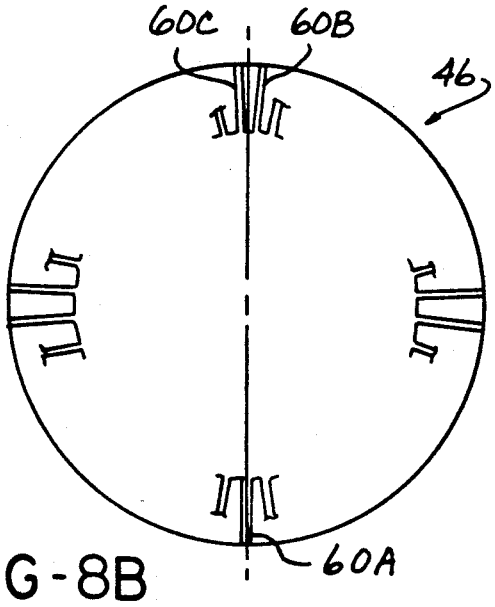
FIG. 8B is a schematic diagram illustrating the pattern of vane spacing employed on the rear side of the impeller.

The foregoing explanation has been concerned solely with determining the spacing of the vanes over the first 180° clockwise from reference vane 58A. The spacing of the vanes at the opposite side of the line L which bisects references vane **58*a* and the space between vanes 58B and 58C is precisely the same pattern except the spacing progression commences at vane 58A and proceeds counterclockwise as viewed FIGS. 6 and 8A through 180° from vane 58A. In other words, the pattern of vanes 58 to the right of line L of FIG. 8A is a precise mirror image of the vane spacing at the opposite side of line L. As viewed from the front, as in FIG. 6, the vane spacing or the pattern in which the vanes 58 are arranged about the impeller axis is geometrically balanced on opposite sides of a vertical line passing through the impeller axis as viewed in FIG. 6. To compensate for any imbalance on opposite sides of a horizontal line passing through the impeller axis, as might arise in the manufacturing of the impeller, the vanes 60 at the rear side of the impeller 46 are arranged in precisely the same pattern as the vanes 58 on the front side with the overall pattern displaced 180° about the impeller axis. Thus, the vanes at the rear face of the impeller includes a reference vane 60A from which the vane spacing progressively increases and decreases in the same amounts as that of the vanes 58 with the reference vane 60A being located at the six o'clock position as viewed in FIG. 8B as compared to the 12 o'clock position of the reference vane 58A** on the front side of the impeller.

Figure 7A:
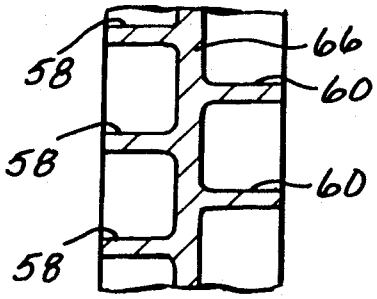
FIG. 7A is an edge view of the impeller showing a portion of the outer periphery of the impeller.

This arrangement achieves two important results. First it achieves a geometric balance of the impeller as a whole on opposite sides of both a vertical and a horizontal plane passing through the impeller axis, and second, as viewed in FIG. 7A, it assures that none of the vanes 58 at the front side of the impeller will be axially aligned with any of the vanes 60 at the rear side of the impeller. Effectively, as far as the generation of noise is concerned, this latter arrangement presents twice as many vanes as would be the case if vanes 58 and 60 were axially aligned because with the disclosed arrangement, when a vane 58 at the front side of the impeller is passing across an edge of the stripper portion, there is no vane 60 aligned with the edge of the stripper portion.

In the case of a 3½ inch diameter impeller with 59 vanes on each side, as shown in the drawings, the frequency at which a vane edge—either an edge of a front vane 58 or a rear vane 60—will pass an edge of the stripper portion will exceed 15,000 cycles per second if the speed of rotation of the impeller exceeds approximately 8400 rpm. Suitable motors for driving an impeller of a 3½ inch diameter at speeds of up to 20,000 rpm in an air pumping application are readily available from a number of commercial sources.

The problem of leakage through the clearance gap between the opposed side surfaces of the impeller and pump housing is usually believed to involve flow across the stripper portions 34, 44 of the pump in that the highest pressure differential within the pump exists between that side of the stripper facing the outlet and that side of the stripper facing the inlet. Most of the prior art efforts directed to reduction of gap leakage losses are concerned with leakage across the stripper, but overlook the fact that significant leakage can occur across the main housing surfaces 26 and 36 as, for example, across the surface 36 between points P1 and P2 (FIG. 2). While the distances leakage of this latter type must traverse are much greater normally than across the stripper, and the pressure differential is much lower than the pressure differential across the stripper, the circumferential extent of the gap through which leakage may pass is substantially greater.

In accordance with the present invention, the opposed side surfaces of the impeller radially inwardly of the impeller vanes are formed with concentric series of recesses or pockets such as 80, 82, 84. These pockets 80, 82 and 84 provide expansion chambers into which fluid flowing through the gap between the impeller side surfaces and housing side surfaces can flow. As compared to leakage flow across opposed flat or unrecessed surfaces, fluid flowing into the recessed pockets 80, 82 and 84, is carried along with the pocket by rotation of the impeller and, at a high speed of rotation of the impeller will eventually be discharged from the pocket at some random location and in a direction which normally will have some radially outwardly directed component of movement as well as a component of movement directed in general toward a high pressure region of the pump chamber. Effectively, this arrangement prevents the formation of any organized continuous flow path through the gap.

One preferential arrangement of the pockets 80, 82, 84 is that shown in FIG. 6 in which the pockets extend in concentric circular patterns in uniformly circumferentially spaced relationships within the circular pattern. The circumferential length and location of the pockets angularly about the impeller axis varies for each concentric circular array of pockets with the pockets 82 circumferentially overlapping the space between adjacent pockets 80 of the next inner most ring, and with the pockets 84 of the outer most ring similarly circumferentially overlapping the spaces between adjacent pockets 82 of the next inner most ring. This arrangement effectively positions one or more pockets in any direct path of flow across the faces 26 or 36 of the housing which might extend between any two points in the pump chamber such as P1 and P2 of FIG. 2 which are sufficiently spaced from each other to develop any substantial pressure differential.

The configuration and location of the pockets 80, 82, and 84 may take any of several alternative forms which may be chosen in accordance with the structural requirements of the impeller and the tooling and fabrication techniques employed to form the pockets. Generally speaking, it is desired that a plurality of concentric rings of pockets in which the pockets in the respective rings circumferentially overlap the spaces between the pockets in adjacent rings be employed, and the arrangement shown in the drawings is but one example of such a preferred arrangement.

As shown in FIG. 6, the pockets 80, 82 and 84 are elongated circumferentially of the impeller and each circular array of pockets has a uniform length proportional to the radial distance between the pockets and the impeller axis. The circumferential length of the pockets 80, 82 and 84 in any circular array exceeds the space between the pockets in a next adjacent circular array. If an imaginary line were drawn on FIG. 6 extending radially from the impeller axis to bisect the space between two adjacent pockets of one circular array, the imaginary line would also circumferentially bisect a pocket in an adjacent circular array.

While it is greatly preferred that the pockets be formed in the impeller, where the construction of the impeller makes this impractical, the pockets may be formed in the housing and cover in the surfaces 26, 36.

While the exemplary embodiments of the invention have been described above in detail, it will be apparent to those skilled in the art the disclosed embodiments may be modified. Therefore, the foregoing description is to be considered exemplary rather than limiting, and the true scope of the invention is that defined in the following claims:

I claim:

1. In a toric pump including a pump housing having an internal impeller receiving chamber defined in part by a pair of spaced parallel side wall surfaces, a disk-like pump impeller mounted in said impeller chamber between said side wall surfaces for rotation about an axis normal to said side wall surfaces, opposed annular recesses in said side wall surfaces defining a toric pump chamber extending circumferentially of said axis from an inlet end to an outlet end, said impeller having planar side faces in opposed facing relationship to the respective side wall surfaces of said impeller chamber and a plurality of vanes at opposite sides of said impeller lying in respective general planes radiating from said axis for driving fluid in said pump chamber from said inlet end to said outlet end, said inlet and outlet ends of said recesses being separated from each other by stripper portions on said housing co-planar with the respective side wall surfaces of said impeller chamber and defining a restricted passage for said vanes while inhibiting flow of fluid from said outlet through said restricted passage;

the improvement wherein said planar side faces of said impeller radially inwardly of said vanes are spaced from the respective opposed side wall surfaces of said impeller chamber by a clearance gap of a width sufficient to accommodate free rotation of said impeller relative to said housing and insufficient to accommodate any substantial flow of fluid through said clearance gap, means defining a plurality of pockets in said side faces of said impeller arranged in at least two circular arrays at different radial distances from the impeller axis, the pockets in each circular array being uniformly circumferentially spaced from each other with the spaces between the pockets of one circular array being radially aligned with the pockets of the other circular array, the pockets in each side face being separated axially from one another preventing direct axial fluid flow communication between the pockets in opposite side faces.

2. The invention defined in claim 1 wherein said pockets are elongated circumferentially of said impeller, the pockets of each circular array being of a uniform length proportional to the radial distance between the pockets and the impeller axis.

3. The invention defined in claim 1 wherein the circumferential length of the pockets in any circular array exceeds the space between the pockets in a next adjacent circular array.

4. In a toric pump including a pump housing having an internal impeller receiving chamber defined in part by a pair of spaced parallel side wall surfaces, a disk-like pump impeller mounted in said impeller chamber between said side wall surfaces for rotation about an axis normal to said side wall surfaces, opposed annular recesses in said side wall surfaces defining a toric pump chamber extending circumferentially of said axis from an inlet end to an outlet end, said impeller having planar side faces in opposed facing relationship to the respective side wall surfaces of said impeller chamber and a plurality of vanes at opposite sides of said impeller lying in respective general planes radiating from said axis for driving fluid in said pump chamber from said inlet end to said outlet end, said inlet and outlet ends of said recesses being separated from each other by stripper portions on said housing co-planar with the respective side wall surfaces of said impeller chamber and defining a restricted passage for said vanes while inhibiting flow of fluid from said outlet through said restricted passage;

the improvement wherein said planar side faces of said impeller radially inwardly of said vanes are spaced from the respective opposed side wall surfaces of said impeller chamber by a clearance gap of a width sufficient to accommodate free rotation of said impeller relative to said housing and insufficient to accommodate any substantial flow of fluid through said clearance gap, means defining a plurality of pockets in said side faces of said impeller arranged in at least two circular arrays at different radial distances from the impeller axis, the pockets in each circular array being uniformly circumferentially spaced from each other with the spaces between the pockets of one circular array being radially aligned with the pockets of the other circular array, wherein the circumferential length of the pockets in any circular array exceeds the space between the pockets in a next adjacent circular array, and an imaginary line extending radially from said impeller axis to bisect the space between two adjacent pockets of one circular array also circumferentially bisects a pocket in an adjacent circular array.

5. In a toric pump including a pump housing having an internal impeller receiving chamber defined in part by a pair of spaced parallel side wall surfaces, a disk-like pump impeller mounted in said impeller chamber between said side wall surfaces for rotation about an axis normal to said side wall surfaces, opposed annular recesses in said side wall surfaces defining a toric pump chamber extending circumferentially of said axis from an inlet end to an outlet end, said impeller having planar side faces in opposed facing relationship to the respective side wall surfaces of said impeller chamber and a plurality of vanes at opposite sides of said impeller lying in respective general planes radiating from said axis for driving fluid in said pump chamber from said inlet end to said outlet end, said inlet and outlet ends of said recesses being separated from each other by stripper portions on said housing co-planar with the respective side wall surfaces of said impeller chamber and defining a restricted passage for said vanes while inhibiting flow of fluid from said outlet through said restricted passage;

the improvement wherein said planar side faces of said impeller radially inwardly of said vanes are spaced from the respective opposed side wall surfaces of said impeller chamber by a clearance gap of a width sufficient to accommodate free rotation of said impeller relative to said housing and insufficient to accommodate any substantial flow of fluid through said clearance gap, means defining a plurality of pockets in said side faces of said impeller arranged in at least two circular arrays at different radial distances from the impeller axis, the pockets in each circular array being uniformly circumferentially spaced from each other with the spaces between the pockets of one circular array being radially aligned with the pockets of the other circular array, wherein the vanes at one side of said impeller lie in radial general planes which are non-uniformly angularly spaced about said axis at one side of said impeller in a pattern such that a first radial plane bisects a first vane at said one side of said impeller and bisects the space between two adjacent vanes at said one side of said impeller at a location 180° from said first vane, the vanes at said one side of said impeller located at one side of said first radial plane being non-uniformly angularly spaced in a mirror image relationship to the non-uniform spacing between the vanes at said one side of said impeller located at the other side of said first radial plane, the vanes at the opposite side of said impeller being arranged in the same non-uniform angular spacing as the vanes at said one side of said impeller with the vanes at said opposite side being angularly displaced 180° about said axis from the respective corresponding vanes at said one side.

6. In a toric pump including a pump housing having an internal impeller receiving chamber defined in part by a pair of spaced parallel side wall surfaces, a disk-like pump impeller mounted in said impeller chamber between said side wall surfaces for rotation about an axis normal to said side wall surfaces, opposed annular recesses in said side wall surfaces defining a toric pump chamber extending circumferentially of said axis from an inlet end to an outlet end, said impeller having planar side surfaces in opposed facing relationship to the respective side wall surfaces of said impeller chamber and a plurality of vanes at opposite sides of said impeller lying in respective general planes radiating from said axis for driving fluid in said pump chamber from said inlet end to said outlet end, said inlet and outlet ends of said recesses being separated from each other by stripper portions on said housing co-planar with the respective side wall surfaces of said impeller chamber and defining a restricted passage for said vanes while inhibiting flow of fluid from said outlet through said restricted passage;

the improvement wherein said planar side faces of said impeller radially inwardly of said vanes are spaced from the respective opposed side wall surfaces of said impeller chamber by a clearance gap of a width sufficient to accommodate free rotation of said impeller relative to said housing and insufficient to accommodate any substantial flow of fluid through said clearance gap, means defining a plurality of pockets in said side faces of said impeller arranged in at least two circular arrays at different radial distances from the impeller axis, the pockets in each circular array being uniformly circumferentially spaced from each other with the spaces between the pockets of one circular array being radially aligned with the pockets of the other circular array, said pockets elongated circumferentially of said impeller, the pockets of each circular array being of a uniform length proportional to the radial distance between the pockets and the impeller axis, the circumferential length of the pockets and any circular array exceeding the space between the pockets in a next adjacent circular array, wherein an imaginary line extending radially from said impeller axis to bisect the space between two adjacent pockets of one circular array also circumferentially bisects a pocket in an adjacent circular array, and the vanes at one side of said impeller lie in radial general planes which are non-uniformly angularly spaced about said axis at one side of said impeller in a pattern such that a first radial plane bisects a first vane at said one side of said impeller and bisects the space between two adjacent vanes at said one side of said impeller at a location 180° from said first vane, the vanes at said one side of said impeller located at one side of said first radial plane being non-uniformly angularly spaced in a mirror image relationship to the non-uniform spacing between the vanes on said one side of said impeller located at the other side of said first radial plane, the vanes at the opposite side of said impeller being arranged in the same non-uniform angular spacing as the vanes at said one side of said impeller with the vanes at said opposite side being angularly displaced 180° about said axis from the respective corresponding vanes at said one side.

* * * * *